United States Patent [19]

DiDomenico

[11] Patent Number: 4,739,878

[45] Date of Patent: Apr. 26, 1988

[54] JEWELRY DISPLAY CARD AND COMPOSITE SHEET OF DISPLAY CARDS

[76] Inventor: Joseph DiDomenico, 575 Mount Pleasant Ave., Providence, R.I. 02908

[21] Appl. No.: 934,268

[22] Filed: Nov. 24, 1986

[51] Int. Cl.[4] ..... B65D 85/56; A47F 7/00

[52] U.S. Cl. ..... 206/45.14; 206/348; 206/566; 206/806; 211/13

[58] Field of Search ..... 206/348, 562, 469, 566, 206/806, 45.14; 211/13, 94; 248/214, 215, 301, 322, 339, 340, 341; 40/124

[56] References Cited

U.S. PATENT DOCUMENTS

| | | | |
|---|---|---|---|
| 484,677 | 10/1892 | Schwerdt | 206/348 |
| 1,527,719 | 2/1925 | Wetherell | 206/348 |
| 1,949,792 | 3/1934 | Etherton | 229/43 X |
| 2,302,045 | 11/1942 | Neumann et al. | 206/348 X |
| 2,472,532 | 6/1949 | Hellman | 206/348 |
| 2,979,301 | 4/1961 | Reveal | 248/214 |
| 2,992,854 | 7/1961 | Berlin | 248/215 X |
| 3,870,144 | 3/1975 | Hanson | 206/45.14 |
| 3,907,104 | 9/1975 | Taub | 206/45.23 |
| 4,099,611 | 7/1978 | Feibelman | 206/566 X |
| 4,113,109 | 9/1978 | Donnelli et al. | 206/806 X |
| 4,391,375 | 7/1983 | Joyce | 211/13 |
| 4,442,942 | 4/1984 | Cuminale et al. | 211/13 |
| 4,572,380 | 2/1986 | Langwell | 206/449 X |

*Primary Examiner*—Stephen Marcus

*Attorney, Agent, or Firm*—Salter & Michaelson

[57] ABSTRACT

A composite sheet of jewelry display cards comprises a plurality of display cards which are integrally struck in a sheet of cardboard material so that the cards are removably secured in the composite sheet by score lines. The display cards in the sheet comprise integrally struck card and hanger portions wherein the card portions are adapted for receiving jewelry items such as earrings or the like thereon, and the hanger portions are rearwardly bendable for suspending the display cards from display racks.

12 Claims, 2 Drawing Sheets

JEWELRY DISPLAY CARD AND COMPOSITE SHEET OF DISPLAY CARDS

BACKGROUND AND SUMMARY OF THE INVENTION

The instant invention relates to display apparatus for jewelry and more particularly to a novel jewelry display card and to a composite sheet comprising a plurality of display cards.

Jewelry display cards have been found to be highly effective devices for displaying various types of jewelry items, including earrings, pendants, and pins, in retail displays. In this connection, one of the most common types of heretofore available jewelry display cards has been made of plastic and has comprised a substantially flat planar card portion and a hanger portion which extends integrally rearwardly from the upper extremity of the card portion for suspending the card from a display rack. The card portion of a display card of this type has generally had a pair of apertures therethrough for securing a pair of jewelry items thereon with fastening elements, such as the pins or posts of the jewelry items, and in some cases the card portion has also had a decorative fabric or the like on the front side thereof for providing a background for the jewelry items. Display cards of this type have generally been found to be particularly effective for displaying jewelry items, such as pierced earrings, in retail displays. For applications of this type, a pair of earrings has normally been assembled on the card portion of a display card so that the posts of the earrings extend through the apertures, and clutches have been assembled with the posts on the rear side of the card. In many cases jewelry items, such as earrings, have been assembled with display cards by jewelry manufacturers before they have been shipped to distributors and/or retail outlets, and hence they have not only been utilized for displaying the jewelry items but also for maintaining items, such as earrings, in assembled pairs during shipping and handling. However, while display cards of the above described type have been found to be effective for both packaging and displaying jewelry items, they have also been found to be relatively expensive, and they have been found to represent a significant cost factor, particularly when utilized for displaying low-priced costume jewelry items. In addition, it has been found that it is inherently difficult to assemble display cards of the above described type in an orderly manner, and therefore it is has also been found that it is inherently difficult to maintain proper inventories of specific carded jewelry items after they have been comingled with other carded jewelry items.

The instant invention provides a noval and effective display card and composite sheet of display cards which effectively overcome many of the disadvantages of the heretofore available jewelry display cards. Specifically, the display card of the subject invention is preferably made of cardboard, and it can be simply and easily manufactured at a substantially reduced cost. Further, the display card is preferably integrally struck in a composite sheet comprising a plurality of display cards which are detachably secured in the composite sheet. This enables jewelry manufacturers to assemble jewelry items with the display cards while they are still on the composite sheet so that the display cards and the jewelry items are held in a neat and orderly assembled relation which is easily manageable by manufacturers, distributors and retailers.

The jewelry display card of the instant invention comprises integrally struck card and hanger portions, wherein the hanger portion comprises at least one hook element which is rearwardly bendable relative to the card portion for engaging a display stand positioned behind the card portion in order to support the display card from the stand. The card portion is preferably formed so that it has at least one aperture therethrough for receiving a pin-like fastening element of a jewelry item in order to secure the jewelry item on the display card. Further, the display card preferably includes at least one ear which is integrally struck in the card portion so that it is forwardly bendable relative thereto for receiving a jewelry item on the ear. In this regard, an ear of a display card of this type can be effectively utilized for receiving a non-pierced earring on the card, and by providing an aperture in the ear, it can also be utilized for receiving a pierced earring on the card. Preferably the display card of the instant invention comprises a pair of rearwardly bendable hook elements for securing it on a display stand and a pair of forwardly bendable ears for receiving a pair of earrings or the like on the display card. The composite sheet of the subject invention preferably comprises a plurality of display cards which are integrally struck in a single sheet so that they are attached to the sheet with score lines but nevertheless easily removable therefrom. The composite sheet is preferably constructed of carboard, and it preferably includes a plurality of the display cards which are integrally struck in the sheet and positioned in substantially aligned rows thereon.

Accordingly, it is a primary object of the instant invention to provide a jewelry display card comprising integrally struck display card and hanger portions.

Another object of the instant invention is to provide an effective inexpensive jewelry display card which can be integrally struck from cardboard.

Another object of the instant invention is to provide a composite sheet comprising a plurality of integrally struck jewelry display cards.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
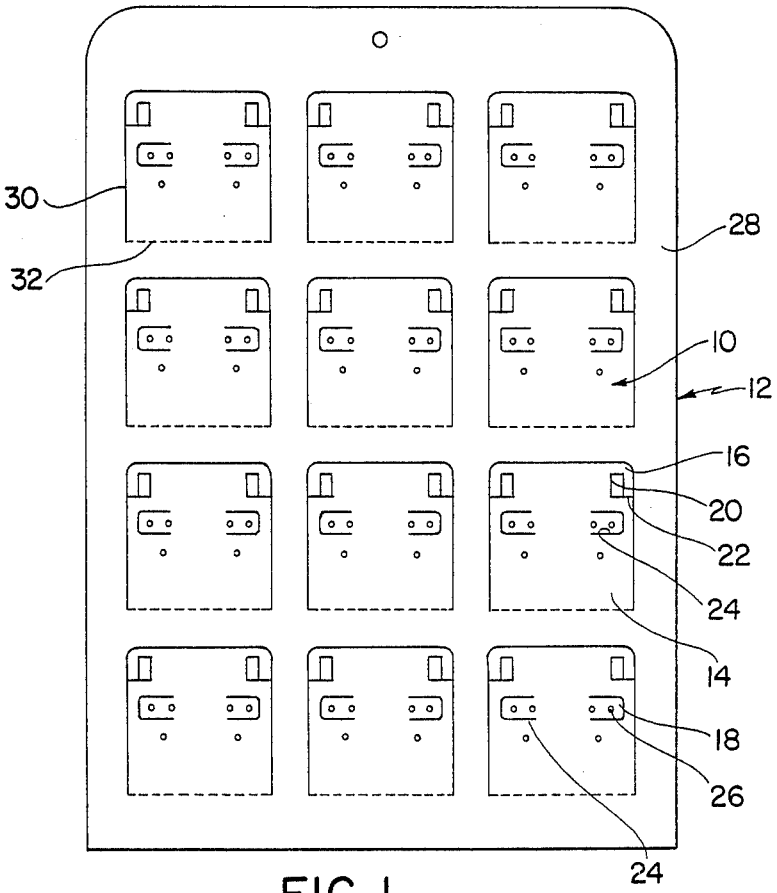
FIG. 1 is a plan view of the composite sheet of the subject invention.
Figure 2:
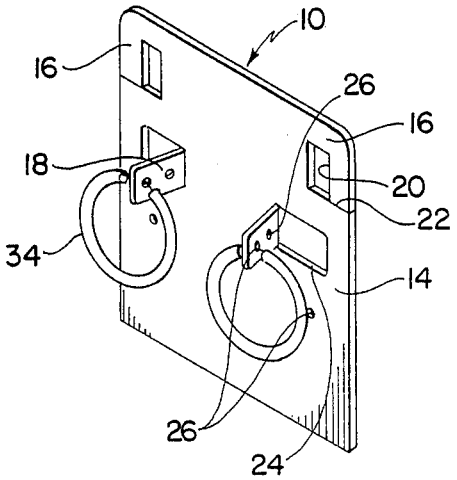
FIG. 2 is a perspective view of a display card of the subject invention with a pair of earrings thereon.
Figure 3:
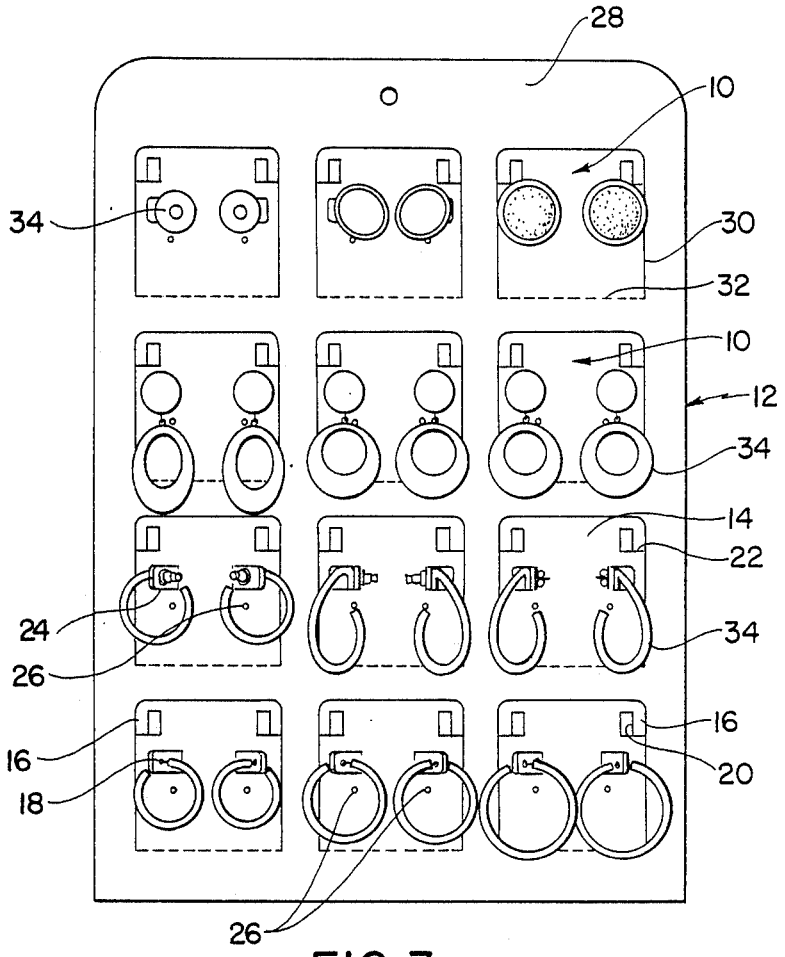
FIG. 3 is a plan view of the composite sheet with a plurality of pairs of earrings thereon.
Figure 4:
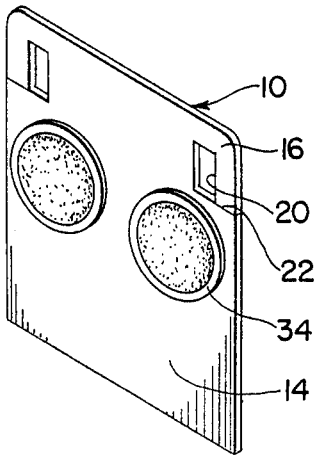
FIG. 4 is a perspective view of a display card of the subject invention with a different pair of earrings thereon.
Figure 5:
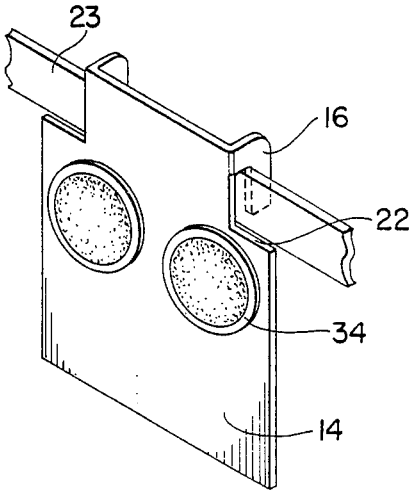
FIG. 5 is a perspective view thereof with the hook elements of the display card bent rearwardly and received on a hanager.

Referring now to the drawings, the jewelry display card of the subject invention is illustrated in FIGS. 1 through 5 and generally indicated at 10, and the composite sheet of the subject invention which comprises a plurality of the display cards 10 is illustrated in FIGS. 1 and 3 and generally indicated at 12. The composite sheet 12 is preferably formed from a substantially rigid sheet of cardboard material, and the cards 10 are preferably integrally struck in the composite sheet 12 so that they are detachably secured in the sheet 12 but easily removable therefrom.

The display cards 10 preferably each comprise a substantially planar card portion 14, a pair of hook or hanger portions 16 which are integrally struck with the card portion 14 thereof, and a pair of ears 18 which are also preferably integrally struck with the card portion 14 thereof. Each of the cards 10 is preferably of substantially rectangular configuration, and the hanger portions 16 thereof are preferably integrally formed as hook-shaped elements at the upper corners of the cards 10. The display cards 10 preferably have substantially rectangular configurations and substantially straight and parallel opposite side edges, and the hanger portions 16 are preferably formed within the substantially rectangular confines of the cards 10. Specifically, the hanger portions 16 are preferably formed so that they include upper portions which extend outwardly or rearwardly and rear portions which extend downwardly, and the inner extremities of the hanger portions 16 are preferably defined by cutouts 20 and slits 22 which extend outwardly from the cutouts 20 to the adjacent side edges of the cards 10 and are formed therewith in a stamping operation during the manufacture of the cards 10. The cards 10 are preferably formed from a material such as cardboard so that the hanger portions 16 can be bent rearwardly about at least partially vertically disposed fold lines to define rearwardly extending hook elements adjacent the upper extremities of the cards 10 which enable the cards 10 to be suspended from a hanger or rod of a conventional display rack such as the hanger 23 illustrated in FIG. 5. Specifically, they are adapted so that the hook or hanger portions 16 are receivable on hangers or rods 23 so that the hangers or rods 23 abut the rear surfaces of the card portions 14 and are received between the card portions 14 and the respective rear portions of the hanger or hook portions 16 thereof. The leaves 18 are preferably integrally formed in the central portions of their respective card portions 14, and they are preferably defined by slits 24 which are also preferably formed by stamping. The leaves 18 are forwardly bendable to the positions illustrated in FIG. 2 to enable them to be used for receiving various types of earrings thereon. A pair of apertures 26 is preferably provided in each of the ears 18, and a pair of additional spaced apertures 26 is preferably provided in each of the card portions 14 for securing jewelry items on the cards 10.

The composite sheet 12 is illustrated in FIGS. 1 and 3, and it comprises a plurality of the cards 10 and a border portion 28 which are preferably integrally struck from a single cardboard sheet in a stamping operation. The embodiment of the composite sheet 12 herein set forth comprises four rows of cards 10, each of which comprises three cards 10, although it will be understood that other embodiments which comprise different numbers of rows containing different numbers of cards are contemplated. The sheet 12 is formed with stamped slits 30 which extend around the side and upper peripheries of the cards 10, and stamped score lines 32 which detachably connect the cards 10 to the border portion 28 along the lower edges of the cards 10.

For use of the composite sheets 12, a plurality of jewelry items, such as the earrings 34 illustrated in FIG. 3, is assembled with the cards 10 thereon. In this connection, when the earrings 34 comprise conventional pierced earrings, they can be assembled with the cards 10 by inserting the posts thereof through the apertures in the card portions 14 and then assembling clutches on the posts on the rear sides of the card portions 14. Alternately, other types of earrings 34 can be assembled with the cards 10 by first bending the ears 18 of the cards 10 forwardly for receiving the earrings 34 thereon. In this connection, by bending the ears 18 forwardly, it is possible to assemble pierced earrings therewith so that both the earrings and the clutches are positioned on the front sides of cards 10, as shown in the lower rows of cards 10 in the sheet 12 illustrated in FIG. 3. This type of mounting may be preferable for certain types of pierced earrings, such as those which are formed as circular or open rings or the like as illustrated. Further, by bending the ears 18 forwardly in this manner, it is also possible to assemble non-pierced earrings with the cards 10 by simply securing the non-pierced earrings 34 on the ears 18.

It is seen, therefore, that the instant invention provides an effective jewelry display card and composite sheet of display cards. The composite sheet 12 comprising the display cards 10 can be effectively manufactured in a stamping operation, and it is therefore adapted to be made in relatively inexpensive constructions. Further, jewelry items, such as earrings 34, can be effectively retained in matched pairs on the display cards 10, and the display cards 10 can be effectively retained in a predetermined group on the composite sheet 12 until they are removed from the sheet 12 and assembled on a display rack. Accordingly, it is seen that both the display card 10 and the composite sheet 12 represent significant advancements in the art which have substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A jewelry display card comprising a card element and a pair of hook elements integrally struck with said card element for suspending said display card in a substantially vertical disposition from a display stand, said display card being of substantially rectangular configuration and having substantially straight, parallel opposite side edges, said card element having at least one aperture therethrough for receiving a pin-like fastening element of a jewelry item in order to secure the jewelry item on said display card, said hook elements being disposed within the substantially rectangular confines of the display card and each including an upper portion which is rearwardly bendable relative to said card element about a fold line which is at least partially vertically disposed when said display card is suspended from said display stand and a rear portion which extends downwardly from said upper portion in rearwardly spaced relation to said card element when said upper portion is in a rearwardly bent position, said hook elements being receivable on a substantially horizontal hanger rod of said display stand when said upper portion is in said rearwardly bent position so that said hook elements are hooked over said hanger rod with said hanger rod abutting the rear surface of said card element and received between said card element and said rear portion to suspend said display card in a generally vertical disposition from said hanger rod.

2. In the jewelry display card of claim 1, said card and hanger elements being made of cardboard.

3. The jewelry display card of claim 1 further comprising at least one ear integrally struck in said card portion, said ear being forwardly bendable relative to said card element for receiving a jewelry item thereon.

4. In the jewelry display card of claim 3, said aperture extending through said ear.

5. The jewelry display card of claim 3 further comprising a pair of said ears integrally struck in said card element.

6. In the jewelry display card of claim 5, each of said ears having an aperture therethrough.

7. The jewelry display card of claim 1, further comprising a pair of said hook elements.

8. In the display card of claim 1, said hook elements being defined by cutouts which are disposed in inwardly spaced relation adjacent the opposite side edges of the display card and slits which extend outwardly from the cutouts to the respective adjacent side edges of the display card thereof.

9. A composite sheet comprising a plurality of display cards integrally struck therein, said display cards each being of substantially rectangular configuration and having substantially straight opposite side edges, said display cards each comprising a card element and a pair of hook elements integrally struck with the card element thereof within the substantially rectangular confines of the display card thereof, said hook elements being operative for suspending the respective display cards thereof in substantially vertical dispositions from a display stand, said card elements each having at least one aperture therethrough for receiving a pin-like fastening element of a jewelry item in order to secure the jewelry item on the display card, said hook elements each including an upper portion which is rearwardly bendable relative to the respective card element thereof about a fold line which is at least partially vertically disposed when the respective display card is suspended from said display stand and a rear portion which extends downwardly from the respective upper portion thereof in rearwardly spaced relation to the respective card element thereof when the respective upper portion thereof is in a rearwardly bent position, said hook elements each being receivable on a substantially horizontal hanger rod of said display stand when the respective upper portion of the hook element is in said rearwardly bent position so that the hook element is hooked over said hanger rod with said hanger rod abutting the rear surface of the respective card element and received between the respective card element and the respective rear portion of the hook element to suspend said display card in a generally vertical disposition from said hanger rod.

10. In the composite sheet of claim 9, said display cards being removably attached to said sheet with score lines.

11. The composite sheet of claim 10 integrally formed from cardboard.

12. In the composite sheet of claim 9, the hook elements of each display card being defined by cutouts which are disposed in inwardly spaced relation adjacent the opposite side edges of the display card thereof and slits which extend outwardly from the cutouts thereof to the respective adjacent side edges of the display card thereof.

* * * * *